United States Patent [19]

Eftefield

[11] 3,974,882

[45] Aug. 17, 1976

[54] CELLULAR BULLDOZER BLADE WITH BUILT-IN SUPPORT BRACKETS

[75] Inventor: Larry G. Eftefield, Joliet, Ill.

[73] Assignee: Caterpillar Tractor Co., Peoria, Ill.

[22] Filed: Nov. 26, 1975

[21] Appl. No.: 635,509

[52] U.S. Cl. ..... 172/803

[51] Int. Cl.[2] ..... E02F 3/76

[58] Field of Search ..... 172/801, 802, 803, 804, 172/805, 806, 807, 808, 809

[56] References Cited

UNITED STATES PATENTS

| | | | |
|---|---|---|---|
| 2,311,553 | 2/1943 | Tourneau | 172/804 |
| 2,963,802 | 12/1960 | Gwinn | 172/745 |
| 3,025,620 | 3/1962 | Liess | 172/803 |
| 3,395,764 | 8/1968 | Wirt | 172/803 |
| 3,503,457 | 3/1970 | Smith et al. | 172/803 |
| 3,653,451 | 4/1972 | Fryrear et al. | 172/804 |
| 3,913,684 | 10/1975 | Casey et al. | 172/804 |

*Primary Examiner*—George J. Marlo

*Attorney, Agent, or Firm*—Charles E. Lanchantin, Jr.

[57] ABSTRACT

A cellular bulldozer blade is disclosed which is adapted to be carried by a plurality of support members. The blade includes a transversely extending moldboard having a front face for carrying earth or the like and a rear face, and a plurality of plates are secured to the rear face of the moldboard for cellular reinforcement thereof and to define a bracket receiving recess therein. A built-in bracket including a body portion having a forwardly facing surface and a rearwardly facing surface thereon is disposed in closing relation to the recess and is peripherally weldably secured to the plates. A bearing arrangement is secured to the rearwardly facing surface of the body portion of the bracket for load transferring connection to one of the support members of the blade, and an elongatably penetrating internal web extends forwardly from the forwardly facing surface of the body portion for vertically stiffening the bracket and the cellular construction of the plates.

14 Claims, 9 Drawing Figures

CELLULAR BULLDOZER BLADE WITH BUILT-IN SUPPORT BRACKETS

BACKGROUND OF THE INVENTION

Bulldozer blades for moving earth, snow and the like are well known. Usually they are supportably mounted on a vehicle through a push frame, including a pair of substantially parallel push arms which are pivotally elevated with retraction of a lift jack connected between the forward portion of the vehicle and the back of the blade. Over the years, the support system and blade construction has become more complex in order to better resist heavy loads and to allow the blade to be adjusted to various working attitudes. Exemplifying such bulldozer blade arrangements are U.S. Pat. Nos. 2,311,553 to R. G. LeTourneau; 2,963,802 to J. M. Gwinn, Jr.; 3,503,457 to J. R. Smith et al. In addition, U.S. Pat. Nos. 3,025,620 to R. K. Liess and 3,395,764 to L. A. Wirt, and assigned to the assignee of the present invention, are particularly representative of bulldozer blade arrangements which are used for more severe working applications such as prying out boulders, tree trunks and the like under heavy impact loads.

As is also known, the bulldozer blades of the above mentioned type incorporate a forwardly disposed moldboard and a plurality of plates which are weldably secured rearwardly to the moldboard so that a cellular blade frame is provided for maximum strength with less weight. Typically, a plurality of support brackets are weldably secured to the rear face of such blade frame after it is completely fabricated, with the result that these brackets and their peripheral weld joints suffer various forms of failure after severe use. Moreover, even though some blades have utilized support brackets which have been limitedly built into such a blade frame, they have not been satisfactory because of their fabricated piece-part construction or their poor load transmitting relationship with respect to other plate members intermediate the bracket itself and the moldboard.

SUMMARY AND OBJECTS OF THE INVENTION

Accordingly, in order to overcome the aforementioned problems, it is an object of this invention to provide an improved cellular bulldozer blade having support brackets thereon which are fully integrated into the construction of the blade to enable working forces to be transferred between the support members and the moldboard of the blade.

It is another object of the present invention to provide an improved cellular bulldozer blade of the character described having weldably built-in support brackets in order to minimize bracket distortion and/or weld failure of the various bracket joints after extended periods of severe use.

Other objects and advantages of the present invention will become more readily apparent upon reference to the accompanying drawings and following description.

DESCRIPTION OF THE PREFERRED EMBODIMENT

Figure 1:
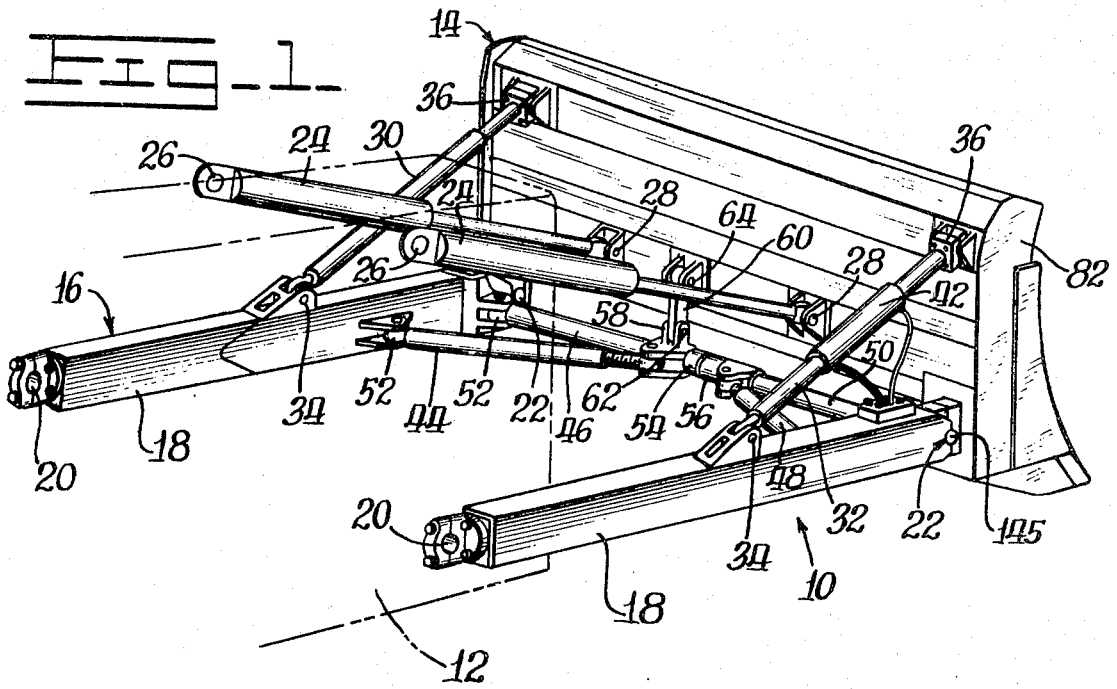
FIG. 1 is a right rear oblique perspective view of the bulldozer blade arrangement of the present invention including a typical push frame and support assembly for mounting thereof to a vehicle.

Referring now to FIG. 1 of the drawings, a bulldozer blade arrangement 10 is shown as being mounted on the front end of a vehicle such as an earthmoving tractor 12. The arrangement includes a cellular bulldozer blade 14 constructed in accordance with the present invention and a push frame and support assembly 16 of the type generally disclosed in U.S. Pat. No. 3,395,764 mentioned above.

The push frame and support assembly 16 includes a pair of substantially parallel push arms 18 which are universally pivotally connected to the tractor 12 at their rear ends at bearing joints 20, and are universally pivotally connected to the blade 14 at their front ends at bearing joints 22. A pair of hydraulic lift jacks 24 are connected to the tractor at joints 26 and to the blade at joints 28 so that the blade may be raised or lowered in a well known manner.

A pair of tilt braces 30 and 32 serve to hold the bulldozer blade 14 in a substantially vertical position, or at a slight pitch or variation from the vertical. The tilt braces are secured to one of the push arms 18 at a pair of joints 34 and to the back of the blade at a pair of joints 36. As is clearly illustrated in FIG. 1, the right tilt brace includes a hydraulic jack 42 which may be extended or retracted when desired to vary the length of the brace and to impart raising or lowering motion to one end of the blade, and giving the blade what is known as tilt.

Because of the aforementioned blade tilting capability, the push frame and support assembly 16 further includes stress relieving cross bracing including a pair of struts 44 and 46 on the left side, and a pair of corresponding struts 48 and 50 on the right side. These struts are laterally connected to the push arms 18 through similar bearing joints 52, only two of which are shown, and are pairably coupled together centrally thereof through a pair of interconnecting universally misalignable blocks 54 and 56. The left block, when viewing the FIG. 1, has a pair of ears 58 secured thereto and an upstanding link 60 is pivotally coupled thereto at a lower bearing joint 62 and to the back of the bulldozer blade 14 at an upper bearing joint 64. In this way the struts can move slightly toward and away from the blade, and yet are restrained from vertical movement by the link 60 as the blade is tilted as is set forth in greater detail in aforementioned U.S. Pat. No. 3,395,764.

Figure 3:
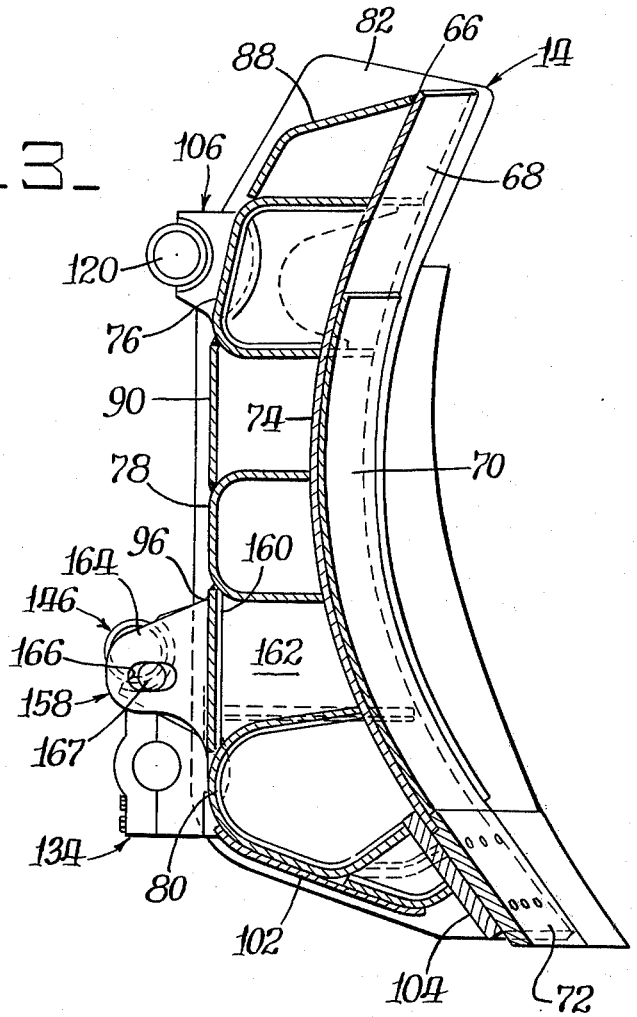
FIG. 3 is an enlarged longitudinal sectional view of the cellular bulldozer blade as taken along the line III—III of FIG. 2.

More particularly, and as best shown in FIG. 3, the cellular bulldozer blade 14 of the present invention includes a transversely extending, arcuately shaped moldboard 66 for carrying earth or the like thereon, and further has a front face 68 to which are secured a reinforcement plate 70 and a plurality of cutting edge members 72 secured thereto. The moldboard has a rear face 74 thereon to which is weldably secured three forwardly facing and substantially parallel C-shaped channel members, namely, and upper channel member 76, a centrally disposed channel member 78, and lower channel member 80.

Figure 2:
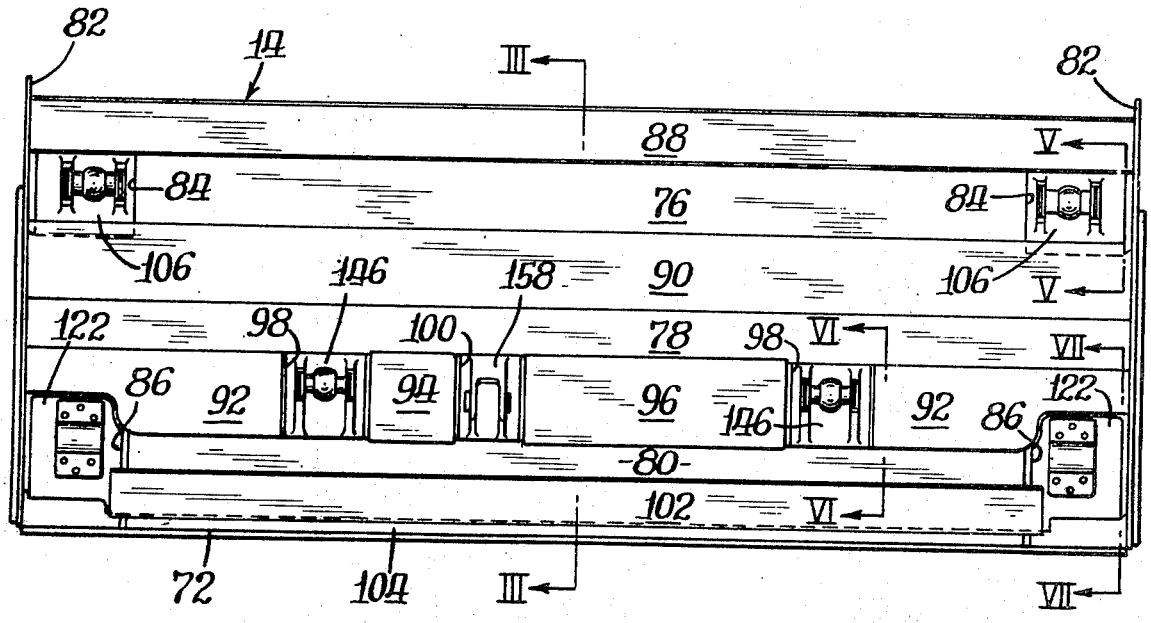
FIG. 2 is a rear elevational view of the cellular bulldozer blade shown in FIG. 1.

As is clearly illustrated in FIG. 2, the central channel member 78 extends horizontally the full width of the moldboard 66 to be endwardly weldably secured to a pair of opposite side walls 82. On the other hand, the upper channel member 76 is foreshortened with respect to the side walls to provide a bracket-receiving recess 84 at each end thereof, and the lower channel member 80 is also foreshortened to provide a bracket receiving recess 86 at its opposite ends. A convexly formed top plate 88 extends between the side walls and is secured thereto and to the upper rear portion of the upper channel member, and a flat plate 90 extends between the side walls and is spannably secured to the facing rear portions of the upper and central channel members to further define the boundaries of the upper recesses 84. A pair of symmetrically opposite and foreshortened plates 92 are weldably secured to the sidewalls and the central and lower channel members, and endwardly serve to define the upper boundaries of the lower recesses 86. Two other plates, namely, a plate 94 and a plate 96, are also spannably secured to the central and lower channel members in laterally spaced relation from each other and from the foreshortened plates 92 to define a pair of similar and laterally outward recesses 98 therebetween as well as an off center recess 100. Furthermore, a foreshortened and appropriately contoured lower plate assembly 102 is weldably secured to the lower surfaces of the lower channel member 80 as best shown in FIG. 3, and to the rear face of a cutting edge support member 104 similarly secured to the rear of the moldboard 66.

Figure 4:
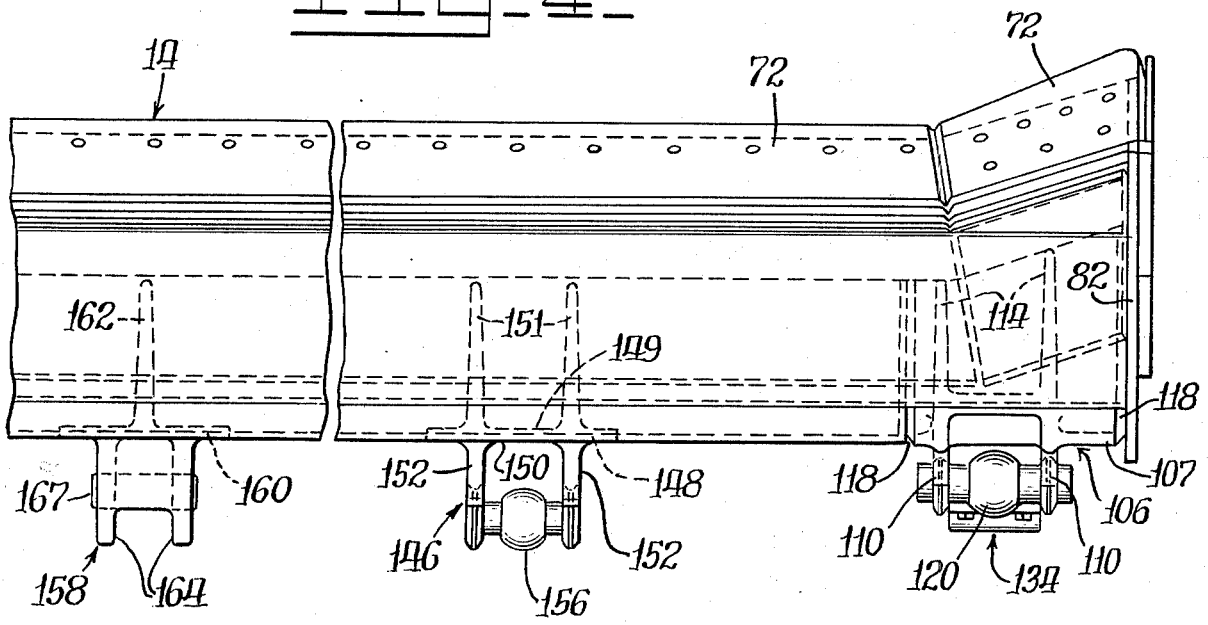
FIG. 4 is an enlarged and fragmentary top plan view of the right hand portion of the cellular bulldozer blade of FIG. 2.
Figure 5:
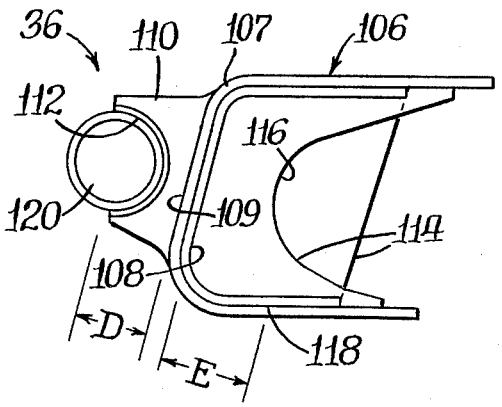
FIG. 5 is an enlarged right side elevational view of the upper right hand tilt brace bracket which is built into the cellular bulldozer blade of the present invention as if viewed from the line V—V of FIG. 2.

Pursuant to the present invention, each of the upper recesses 84 is adapted to receive a tilt brace bracket 106 closely therein, which pair of symmetrically oppositely formed brackets are coupled to the upper portion of the tilt braces 30 and 32 illustrated in FIG. 1. As best shown in FIGS. 4 and 5, each tilt brace bracket is castably formed of steel or the like and includes a body portion 107 of generally forwardly facing C-shaped construction that provides a forwardly facing surface 108 and a rearwardly facing surface 109 thereon, which surfaces are laterally aligned with corresponding surfaces on the upper channel member 76. Furthermore, a pair of load bearing ears 110 extend integrally rearwardly from the rearwardly facing surface of the body portion and individually have a semi-cylindrical opening 112 therein, and a pair of laterally spaced and upstanding integral webs 114 extend integrally forwardly from the forwardly facing surface in individually convergingly tapered relation within the body portion. The laterally outer web has a concave recess 116 therein to permit weld access to the inner web, which is subsequently weldably secured to the rear face 74 of the moldboard 66, and a C-shaped peripheral weld bead groove 118 around each side of the body portion better enables attachement thereof alignably to the upper channel member 76 and to the side wall 82. Thus, the built-in tilt brace brackets 106 are each adapted to weldably receive a pin and spherical bearing member 120 therein to permit the brackets to be coupled to the tilt braces at the joints 36 and 40.

In a somewhat analogous manner, each of the lower recesses 86 shown in FIG. 2 is adapted to receive a push arm bracket 122 closely therein, which brackets are subsequently coupled to the forward ends of the push arms 18 at the bearing joints 22. These castably formed push arm brackets are mirror images of one another and are representatively illustrated by the views of the right hand brackets in FIGS. 7 and 8. They individually include a body portion 123 of generally forwardly facing C-shaped construction that provides a forwardly facing surface 124 and a rearwardly facing mounting surface 125 thereon which are laterally alignable with corresponding surfaces on the lower channel member 80. A plurality of threaded bores 126 open horizontally outwardly on the rear mounting surface thereof, and an upstanding integral web 130 extends forwardly from the forwardly facing surface 124 in convergingly tapered relation within the body portion so that its front extremity can be weldably secured to the rear face 74 of the moldboard 66. Another stiffening web 131 is disposed on the lower front portion thereof to better adapt the bracket to be weldably secured to the obliquely disposed cutting edge support member 104. Moreover, on each side of the bracket 122 a peripheral weld groove 132 is integrally formed in the body portion to better enable welding thereof to the lower channel member 80 aligned laterally inwardly thereof and to the outer side wall 82.

Figure 7:
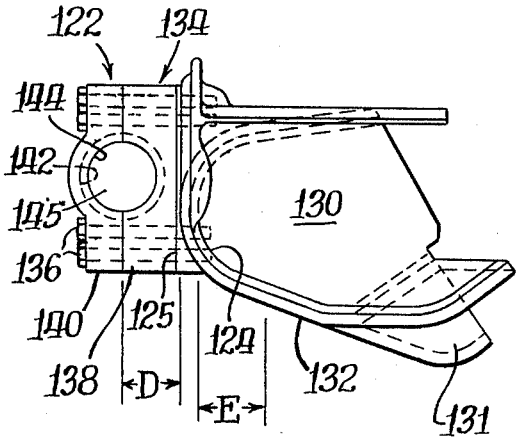
FIG. 7 is an enlarged right side elevational view of the lower right hand push arm bracket as if viewed from the line VII—VII of FIG. 2.
Figure 8:
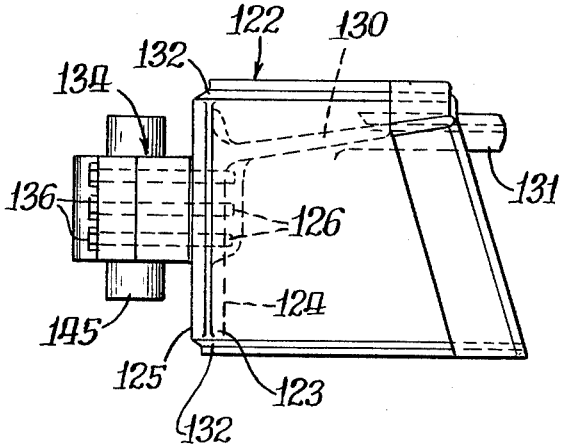
FIG. 8 is a top plan view of the push arm bracket illustrated in FIG. 7.

In the instant example illustrated in FIGS. 7 and 8, a load bearing socket arrangement 134 is secured to the rear mounting surface 125 of each bracket 122 as by a plurality of bolts 136 which extend therethrough and are screw threadably received in the bores 126. The socket arrangement consists of similar bearing halves 138 and 140 with a spherical socket 142 collectively formed therein, and a pair of cylindrical openings 144 also collectively formed between them at their opposite sides. This enables the socket arrangement to be selectively coupled to a laterally extending pin and spherical bearing member 145 secured to the forward end of the push arms 18 as shown in FIG. 1, and thereby forming the bearing joint 22.

Figure 6:
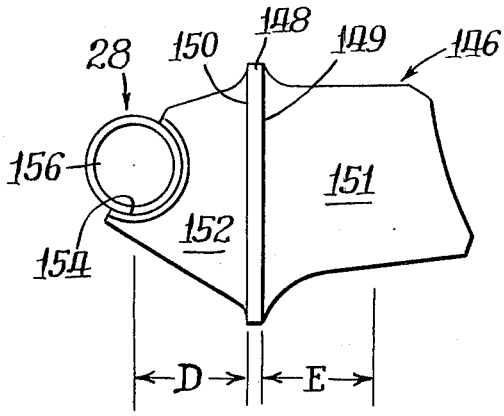
FIG. 6 is an enlarged right side elevational view of a typical blade lift bracket as if viewed from the line VI—VI of FIG. 2.

Referring now to the blade lift joints 28 shown in FIG. 1, the construction thereof is best understood by further reference to FIGS. 2, 4 and 6. A pair of similar blade lift brackets 146 are symmetrically arranged on the rear of the cellular bulldozer blade 14 closely within the recesses 98 thereof. Each of these castably formed brackets is H-shaped in plan view as best illustrated in FIG. 4 and includes a planar central body portion 148 having a forwardly facing surface 149 and a rearwardly facing surface 150 thereon, and which body portion is laterally aligned with the plates 92, 94 and 96. Further, the brackets include a pair of parallel upright webs 151 which extend integrally forwardly from the body portion in individually convergingly tapered relation, and a pair of parallel ears 152 which extend integrally rearwardly from the body portion. As best shown in FIG. 6, the ears have semi-cylindrical recesses 154 therein to permit a pin and spherical bearing member 156 to be weldably secured thereto in horizontally and laterally extending relation to the bracket. The elongatably penetrating webs are appropriately contoured to be closely fitted against the facing surfaces of the channels 78 and 80 and against the rear face 74 of the moldboard 66 to permit secure welding thereof at these locations and thereby its full integration into the cellular construction of the blade.

Lastly, a lateral stabilizing brace bracket 158 is disposed within the recess 100 of the blade 14 intermediate the blade lift brackets 146, but slightly off center therefrom as is clearly illustrated in FIG. 2. As shown in FIGS. 3 and 4, such bracket also includes a central body portion 160, a single integrally formed and forwardly extending upright tapered web 162, and a pair of rearwardly extending and upright ears 164 individually having a longitudinally elongated opening 166 therein to receive a pin 167 and to substantially complete the bearing joint 64. Again, the elongatably penetrating web is contoured to fit closely between the channels 78 and 80, and extends forwardly to the rear face 74 of the moldboard 66 to enable the bracket to be weldably secured thereto in a strong and dependably stiffening built-in manner.

OPERATION

While the operation of the present invention is believed clearly aparent from the foregoing description, further amplification will subsequently be made in the following brief summary of such operation. As may be visualized with respect to FIGS. 1 and 3, loads on the front face 68 and cutting edge members 72 of the bulldozer blade 14 through normal earthmoving operations are generally transmitted rearwardly to be resisted by the push frame and support assembly 16 at the connecting joints 22, 28, 36 and 64. Consequently, the corresponding built-in brackets 122, 146, 106 and 158 thereat are respectively disposed in load transmitting relation generally between the support assembly and the rear face 74 of the blade.

When the brackets 122, 146, 106 and 158 experience longitudinally compressive loads, the rear face 74 of the bulldozer blade 14 beneficially serves to directly bear against the forward extremity of the integrally built-in webs 130, 114, 150 and 162 thereof. While such extended web structure and associated weld joints thereat is preferred, it is to be appreciated that these webs could be limitedly longitudinally foreshortened to provide some space between these webs and the rear face of the blade without departing from the spirit of the present invention. In such an instance, in order to realize a significant degree of benefit of building-in the brackets fully into the cellular structure of the blade, it is desirable to extend the integral webs at least as far forwardly of the central body portions as do the supporting bearing surfaces rearwardly of the body portions. Such construction resists torque or turning force components on the bearing surfaces through the loaded reaction of the penetrating web or webs. In this regard, reference is made to the side views of the brackets 106, 146 and 122 shown in FIGS. 5, 6 and 7, respectively. The distance D identified in these figures represents the longitudinal distance from the central body portions of the respective brackets to the rearwardly disposed load bearing members 120, 156 and 145 thereof. Furthermore, the distance E identified thereon represents the minimum desirable forward extension of the integral webs from the forwardly facing surfaces of their central body portions. In accordance with one aspect of the invention, it is contemplated that the distance E should be at least as great as the distance D, in order to provide a sufficiently deeply penetrating web structure better able to resist oblique loads on the bearing joints and to minimize the observed stresses of the peripheral weld joints connecting the brackets to the associated channel members and plates.

ALTERNATE EMBODIMENT

Figure 9:
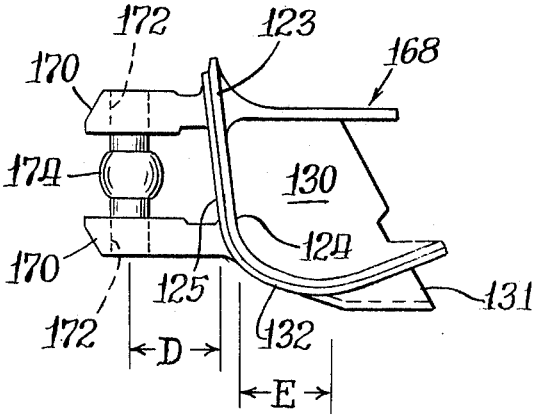
FIG. 9 is a right side elevational view of an alternate push arm bracket.

As shown in FIG. 9, an alternate pair of push arm brackets 168 may be utilized which are similar in many respects to the push arm brackets 122 discussed heretofore, and common reference numerals have been applied where appropriate to substantially identical parts. It differs only in that it includes a pair of horizontally disposed and parallel ears 170 which form an integral part of the bracket by extending rearwardly from the rearwardly facing surface 125 of the body portion 123. Each of these ears has a vertical bore 172 therein, which ears are alignably disposed for receipt of a pin and spherical bearing member 174. Again, however, the distance E web extension is preferably greater than the distance D in order to better transfer loads through the webs 130 and 131 and to reduce the severity of the stresses on the exterior peripheral welds.

In the manufacture of the cellular bulldozer blade 14, the central and lower channel members 78 and 80 are weldably attached to the rear face 74 of the moldboard and then the stabilizing brace bracket 158 and the blade lift brackets 146 are weldably secured insertably between them. Subsequently, the closure plates 92, 94 and 96 are weldably spannably affixed to the channel members and to the respective brackets to provide a fully integrated and deeply built-in bracket structure. Thereafter, with the horizontally foreshortened upper and lower channel members 76 and 80 secured to the rear face 74 of the moldboard, the tilt brace brackets 106 and push arm brackets 122 are welded laterally alignably thereto. Also, the respective webs 114 and 130 of these brackets are welded to the rear face of the moldboard from the sides of the blade. Then, the remaining plates 88, 90 and 102 are welded spannably to both the channel members and the brackets, and the side walls 82 are endwardly welded to the moldboard, the channel members and to the tilt brace and push arm brackets.

In view of the foregoing, it is readily apparent that the present invention provides an improved bulldozer blade construction with the support brackets therefor integrated into the cellular blade structure rather than being secured to a rear face thereof to better enable working forces to be transferred between the push frame and support assembly and the moldboard. Particularly, the extended length of one or more of the integral webs which extend forwardly of the brackets and deeply into predetermined and closely fitting recesses in the cellular blade structure is such as to permit the brackets to resist extreme loads for extended periods of use with a minimum amount of weld failure at the joints between the bracket and blade elements. Moreover, the formed brackets themselves are castings of steel or the like to present a construction which is strong and yet light weight and economical.

While the invention has been described and shown with particular reference to a preferred embodiment, it will be apparent that variations might be possible that would fall within the scope of the present invention, which is not intended to be limited except as defined in the following claims.

What is claimed is:

1. A cellular bulldozer blade, adapted to be carried by a plurality of support members, comprising;

transversely extending moldboard means including a front face for carrying earth or the like and a rear face;

plate means secured to said rear face of said moldboard means for cellular reinforcement thereof and defining a bracket receiving recess therein; and a bracket including a body portion having a forwardly facing surface and a rearwardly facing surface thereon which is disposed in closing relation to said recess and peripherally weldably secured to said plate means, bearing means secured to said rearwardly facing surface of said body portion for load transferring connection to one of the support members of the blade, and an elongatably penetrating internal web extending forwardly from said forwardly facing surface of said body portion for vertically stiffening the bracket and the cellular construction of said plate means.

2. The cellular bulldozer blade of claim 1 wherein said plate means includes a forwardly facing C-shaped channel member and said bracket is C-shaped and laterally aligned with and weldably secured to said channel member.

3. The cellular bulldozer blade of claim 1 wherein said plate means includes a pair of forwardly facing C-shaped channel members and said web of said bracket extends tightly between said channel members and is welded thereto.

4. The cellular bulldozer blade of claim 3 wherein said web extends forwardly into load bearing engagement with and for weldable attachment to said rear face of said moldboard for greater strength.

5. A cellular bulldozer blade, adapted to be carried by a plurality of support members, comprising;

transversely extending moldboard means including a front face for carrying earth or the like and a rear face;

plate means secured to said rear face of said moldboard means for cellular reinforcement thereof and defining a bracket receiving recess therein; and a bracket including a central body portion disposed in closing relation to said recess, a rearwardly extending member on said central body portion having bearing means thereon for load transferring engagement with one of the support members of the blade, and a forwardly extending integral web on said central body portion that is weldably secured to said rear face of said moldboard means for substantially direct load transfer between said bracket and said moldboard means.

6. The cellular bulldozer blade of claim 5 wherein said plate means includes a forwardly facing and laterally elongated C-shaped channel member, and said bracket is laterally aligned with and weldably secured to said channel member.

7. The cellular bulldozer blade of claim 5 wherein said plate means includes a pair of transversely extending C-shaped channel members and said web of said bracket is contoured to extend closely between them to permit the web to be weldably secured thereto.

8. A cellular bulldozer blade, adapted to be carried by a plurality of support members, comprising;

a transversely extending moldboard including a load carrying front face and a rear face;

a forwardly-facing C-shaped plate transversely secured to said rear face of said moldboard in horizontally fore-shortened relation with respect to the sides of the moldboard; and a forwardly facing C-shaped bracket weldably secured alignably to said C-shaped plate and having integral web means thereon which extends forwardly in an upright manner for weldable attachment to said rear face of said moldboard, and also having bearing means thereon connectable to one of the support members for better transfer of support forces penetratingly into the blade.

9. A cellular bulldozer blade comprising;

a transversely extending moldboard;

forwardly facing C-shaped plate means transversely secured to the rear of said moldboard for cellular reinforcement thereof;

a pair of side walls secured to the laterally opposite ends of said moldboard and providing a recess intermediate each end of said plate means and one of said side walls; and a pair of brackets individually including a C-shaped body disposed in closing relation to each of said recesses and weldably secured to one of said side walls and alignably to said C-shaped plate means, a rearwardly extending bearing member on said body adapted to load transferringly support the blade, and a forwardly extending integral web on said body that is weldably secured to the rear of said moldboard in order to better transfer working forces between said brackets and said moldboard.

10. A cellular bulldozer blade comprising;

a transversely extending moldboard;

a pair of horizontally disposed, forwardly facing C-shaped channel members secured to the rear of said moldboard in substantially transverse parallel relation;

plate means secured spannably between said channel members to define a bracket receiving recess therebetween;

a built-in load transferring and support bracket adapted to be closely received within said recess and weldably secured to said moldboard, said channel members and said plate means to better transfer working forces between said bracket and said moldboard.

11. A cellular bulldozer blade, adapted to be carried by a plurality of support members, comprising;

a transversely extending moldboard;

a plurality of plates secured to the rear face of the moldboard to cellularly reinforce it and defining a pair of laterally spaced recesses therein; and a pair of brackets individually including a central body portion peripherally welded in closing relation to one of said pair of recesses, a pair of rearwardly extending integral ears on said central body portion having bearing means thereon for load transferring engagement with one of the support members, and a pair of forwardly extending integral webs on said central body portion that are weldably secured to the rear face of said moldboard to better transfer working forces between said brackets and said moldboard.

12. A cellular bulldozer blade, adapted to be carried by a plurality of support members, comprising;

transversely extending moldboard means including a front face for carrying earth or the like and a rear face;

plate means secured to said rear face of said moldboard means for cellular reinforcement thereof and defining a bracket receiving recess therein; and a built-in bracket including a body portion disposed in closing relation to said recess, a rearwardly extending member on said body portion having bearing means thereon for load transferring engagement with one of the support members of the blade, and a forwardly extending integral web on said central body portion that is closely disposed within said recess to permit welding thereof to said plate means, said web extending at least as far forwardly of said body portion as does said bearing means rearwardly of said body portion in order to better transfer working forces between said bracket and said moldboard means.

13. A method of manufacturing a cellular bulldozer blade comprising;

forming a transversely extending moldboard;

weldably securing a pair of forwardly facing C-shaped channel members to the rear of said moldboard in substantially transverse parallel relation;

weldably securing a load transferring and support bracket to said moldboard and to said channel members insertably therebetween; and weldably spannably securing a pair of plate members to said channel members and weldably enclosingly securing them to said bracket to provide a deeply built-in bracket structure having improved strength.

14. A method of manufacturing a cellular bulldozer blade comprising;

forming a transversely extending moldboard;

weldably securing a forwardly facing, C-shaped channel member to the rear of said moldboard in horizontally foreshortened relation thereto;

weldably securing a load transferring and support bracket alignably to said channel member and to the rear of said moldboard; and weldably securing a side plate endwardly to said moldboard and said bracket to provide a deeply built-in bracket structure having improved strength.

* * * * *